US008427518B2

(12) United States Patent
Terao et al.

(10) Patent No.: US 8,427,518 B2
(45) Date of Patent: Apr. 23, 2013

(54) IMAGE FORMING DEVICE

(75) Inventors: Akira Terao, Ama-gun (JP); Yasunori Akatsuka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1016 days.

(21) Appl. No.: 12/233,961

(22) Filed: Sep. 19, 2008

(65) Prior Publication Data

US 2009/0087210 A1 Apr. 2, 2009

(30) Foreign Application Priority Data

Sep. 28, 2007 (JP) ..... 2007-253921

(51) Int. Cl.

| | |
|---|---|
| ***B41J 27/00*** | (2006.01) |
| ***B41J 2/435*** | (2006.01) |
| ***G03G 21/00*** | (2006.01) |
| ***G03G 21/18*** | (2006.01) |
| ***B65H 1/08*** | (2006.01) |

(52) U.S. Cl.
USPC ..... 347/242; 347/241; 347/245; 347/257; 399/99; 399/114; 271/127

(58) Field of Classification Search ..... 347/241, 347/242, 245, 256, 257, 263; 399/99, 107, 399/114, 388; 271/10.11, 109, 121, 124–127
See application file for complete search history.

(56) References Cited

U.S. PATENT DOCUMENTS

| | | | | |
|---|---|---|---|---|
| 6,519,431 | B1 * | 2/2003 | Toba et al. | 399/111 |
| 2006/0050135 | A1 * | 3/2006 | Fukuda | 347/138 |

FOREIGN PATENT DOCUMENTS

| | | |
|---|---|---|
| JP | 6-025848 U | 4/1994 |
| JP | 2003-112446 | 4/2003 |
| JP | 2004-333959 | 11/2004 |
| JP | 2006-058454 | 3/2006 |
| JP | 2006-106446 | 4/2006 |
| JP | 2007-065125 | 3/2007 |
| JP | 2007-072321 | 3/2007 |
| JP | 2007-140349 | 6/2007 |

OTHER PUBLICATIONS

Office Action received for counterpart Japanese Application No. 2007-253921, mailed Aug. 18, 2009.
Notification of Reasons of Rejection for Application No. 2007-253921 mailed Feb. 16, 2010.

* cited by examiner

*Primary Examiner* — Charlie Peng
*Assistant Examiner* — Hung Lam
(74) *Attorney, Agent, or Firm* — Banner & Witcoff, Ltd.

(57) ABSTRACT

An image forming device includes a first device body, a second device body attached to the first device body, a photoconductive body provided in the first device body, an exposure unit provided to the second device body, the exposure unit having an exposure surface that exposes the photoconductive body and forms a latent image on the photoconductive body, the exposure unit being movable between an exposure position and an evacuation position, and a cleaning unit cleaning the exposure surface of the exposure unit. The cleaning unit includes a cleaning member cleaning the exposure surface, a supporting member supporting the cleaning member, and a guide member movably guiding the supporting member. The exposure unit is disposed such that the exposure surface is cleaned by the cleaning unit when the exposure unit is moved to the evacuation position.

10 Claims, 10 Drawing Sheets

IMAGE FORMING DEVICE

CROSS-REFERENCE TO RELATED APPLICATIONS

This application claims priority under 35 U.S.C. §119 from Japanese Patent Application No. 2007-253921 filed on Sep. 28, 2007. The entire subject matter of the application is incorporated herein by reference.

BACKGROUND

1. Technical Field

The following description relates to one or more image forming devices such as an electrophotographic copy machine and a printer.

2. Related Art

In an image forming device such as an electrophotographic copy machine and a printer, a laser scanning method and an LED exposure method have been put into practical use as an image writing method (i.e., an exposure method). The LED exposure method is a method in which light emitted by a light emitting unit with a plurality of light emitting elements linearly aligned is directed onto a surface of a photoconductive body with an imaging system and a latent image is formed on the surface of the photoconductive body.

FIG. 10 schematically shows a configuration of a main portion of a known image forming device when viewed in a direction perpendicular to a carrying direction of a recording medium. The image forming device 101 shown in FIG. 10 is configured to perform color printing. In a device main body 102, four drum units 103 are detachably disposed that correspond to yellow (Y), magenta (M), cyan (C), and black (K), respectively, in an order from an upstream side in an arrow D direction as the carrying direction of the recording medium.

Each of the drum units 103 is provided with a photoconductive drum 103*a* configured to rotate in an arrow C direction. Further, images of the predetermined colors are sequentially transferred onto the recording medium which is conveyed in the arrow C direction while being stuck to a carrying belt (not shown) by the respective photoconductive drums 103*a* in collaboration with respective transfer rollers 104 rotated concurrently with the photoconductive drums 103*a*.

Meanwhile, a stacker cover 107 is rotatably supported by the device main body 102 via a rotational shaft 108 extending in a direction perpendicular to the arrow D direction. Further, the stacker cover 107 holds four LED heads 111 disposed in positions corresponding to circumferential surfaces of the photoconductive bodies 103*a* of the drum units 103, respectively. Thus, the stacker cover 107 is configured to be opened and closed with respect to the device main body 102, and provided such that the drum units can be replaced when the stacker cover 107 is opened with respect to the device main body 102 (for example, see Japanese Patent Provisional Publication No. 2003-112446).

SUMMARY

In the above known image forming device with the LED heads 111 held by the stacker cover 107, a mechanism in which the LED heads 111 are turned in conjunction with opening and closing of the stacker cover 107 may be applied. In this case, the LED heads 111 are disposed in exposure positions to expose the circumferential surface of the photoconductive bodies 103*a* when the stacker cover 107 is closed. Further, the LED heads 111 are disposed in evacuation positions where the LED heads 111 are substantially parallel to the stacker cover 107, when the stacker cover 107 is opened. Thereby, it is possible to prevent the LED heads 111 from disturbing replacement of the drum units 103.

Meanwhile, in the image forming device employing the LED heads configured as above, when the stacker cover 107 is closed, an exposure surface of each LED head 111 is located close to a corresponding photoconductive drums 103*a*, respectively. Further, in order to develop an electrostatic latent image on the photoconductive drum 103*a*, a development roller of a developing unit is disposed close to the photoconductive drum 103*a*. Therefore, since the exposure surface of each LED head 111 might be contaminated with toner on a surface of the development roller, the exposure surface has to be cleaned periodically.

However, the above image forming device with the LED heads 111 held by the stacker cover 107 is not provided with any cleaning member for cleaning the exposure surfaces. Therefore, there is a problem that a user has to prepare for a cleaning member and clean the exposure surfaces. Additionally, in the image forming device configured such that the LED heads 111 are turned in conjunction with opening and closing of the stacker cover 107, the LED heads 111 are located in the evacuation positions when the stacker cover 107 is opened. Hence, there is another problem that it is difficult for the user to clean the exposure surfaces.

Aspects of the present invention is advantageous to provide one or more improved image forming devices that make it possible to easily clean an exposure surface of an exposure unit thereof.

According to aspects of the present invention, an image forming device is provided, which includes a first device body having an opening, a second device body attached to the first device body in an openable and closable manner, the second device body being configured to cover the opening of the first device body in a closed state thereof, a photoconductive body provided in the first device body, an exposure unit provided to the second device body, the exposure unit having an exposure surface configured to expose a surface of the photoconductive body linearly in a predetermined scanning direction and form a latent image on the surface of the photoconductive body, the exposure unit being configured to be movable between an exposure position where the exposure surface is directed to the surface of the photoconductive body when the second device body is closed and an evacuation position where the exposure unit is evacuated from the exposure position when the second body is opened, and a cleaning unit configured to clean the exposure surface of the exposure unit. The cleaning unit includes a cleaning member configured to clean the exposure surface of the exposure unit, a supporting member configured to support the cleaning member, and a guide member configured to movably guide the supporting member. The exposure unit is disposed such that the exposure surface is cleaned by the cleaning unit when the exposure unit is moved to the evacuation position.

Further, according to another aspect of the present invention, an image forming device is provided, which includes a first device body having an opening, a second device body attached to the first device body in an openable and closable manner, the second device body being configured to cover the opening of the first device body in a closed state thereof, a photoconductive body provided in the first device body, an exposure unit provided to the second device body, the exposure unit having an exposure surface configured to expose a surface of the photoconductive body along a predetermined scanning direction and form a latent image on the surface of the photoconductive body, the exposure unit being configured to be movable between a first position where the exposure surface is directed to the surface of the photoconductive body and a second position where the exposure unit is evacuated from the first position, and a cleaning unit configured to clean the exposure surface of the exposure unit. The exposure unit is disposed such that the exposure surface is cleaned by the cleaning unit when the exposure unit is moved to the second position.

In some aspects, it is possible to easily clean the exposure surface of the exposure unit provided to the second device body with the cleaning unit. Thus, it is possible to prevent formation of an uneven image due to the exposure surface contaminated with toner.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments according to aspects of the present invention will be described with reference to the accompany drawings.

Figure 1:
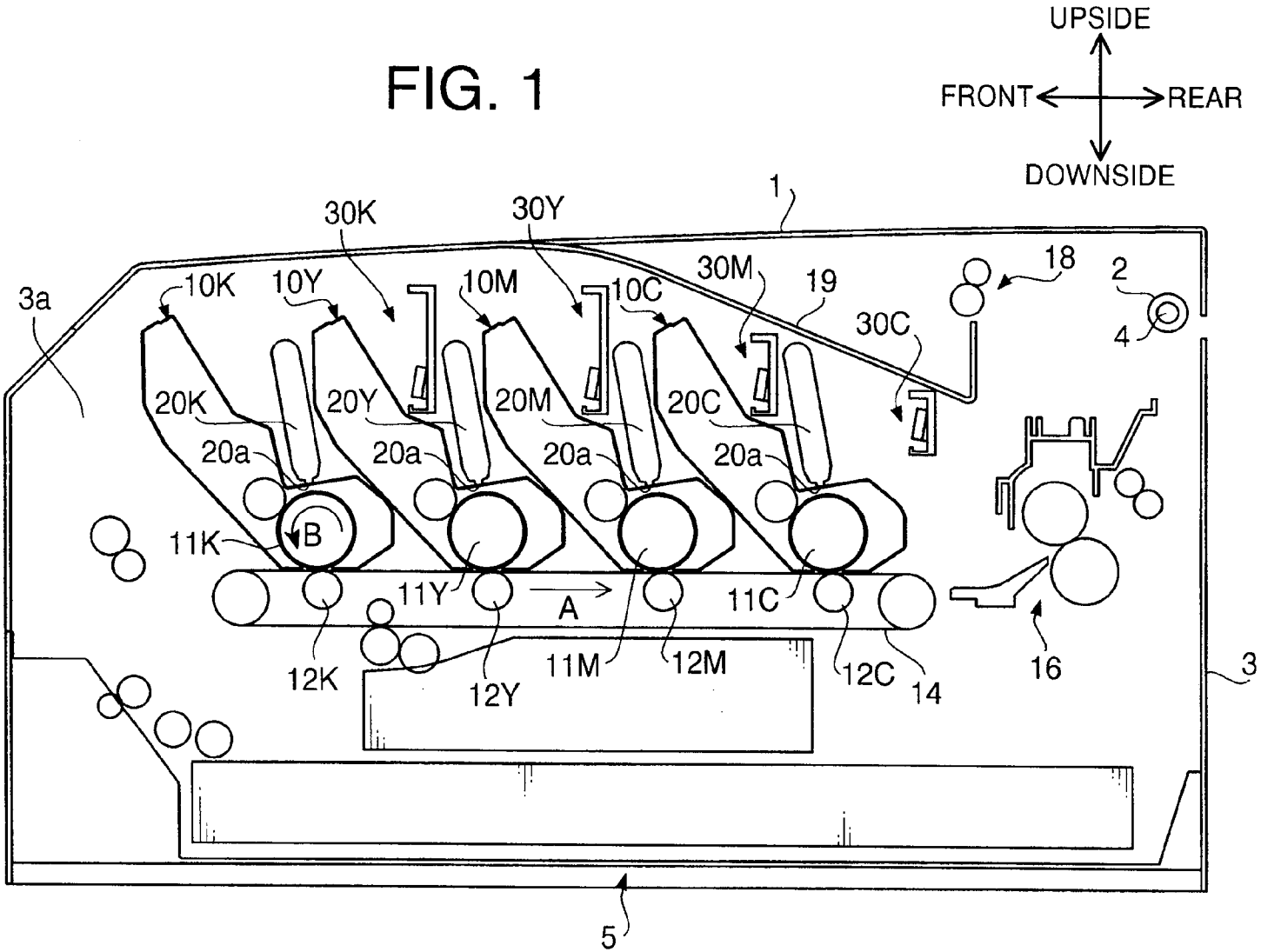
FIG. 1 is a cross-sectional side view schematically showing an entire configuration of an LED printer when an upper case is closed in a first embodiment according to one or more aspects of the present invention.

FIG. 1 is a cross-sectional view schematically showing an entire configuration of an LED printer 5 in a first embodiment according to aspects of the present invention. In the LED printer 5 shown in FIG. 1, a left side, a right side, a back side, and a front side on the figure are defined as a front side, a rear side, a left side, and a right side, respectively.

In FIG. 1, an upper case 1 is supported, rotatably with respect to a mechanical unit 3, by a rotational shaft hole 2 provided at a rear side of the upper case 1 and a rotational shaft 4 provided at a rear side of the mechanical unit 3. Further, the mechanical unit 3 has an opening 3*a* at an upper side thereof. It is noted that FIG. 1 shows a state where the upper case 1 is closed with respect to the mechanical unit 3.

In the mechanical unit 3, four drum units 10K, 10Y, 10M, and 10C are detachably disposed that respectively correspond to black (K), yellow (Y), magenta (M), and cyan (C) in an order from an upstream side in a direction of an arrow A denoting a carrying direction of a recording sheet.

The drum units 10K, 10Y, 10M, and 10C are provided with photoconductive bodies 11K, 11Y, 11M, and 11C, and transfer rollers 12K, 12Y, 12M, and 12C corresponding to the photoconductive bodies 11K, 11Y, 11M, and 11C, respectively. Images of the predetermined colors are sequentially transferred onto the recording sheet, which is conveyed in an arrow A direction while being stuck to a carrying belt 14, by the photoconductive bodies 11K, 11Y, 11M, and 11C in collaboration with the transfer rollers 12K, 12Y, 12M, and 12C rotated concurrently with the photoconductive bodies 11K, 11Y, 11M, and 11C. Thereafter, the images of the predetermined colors on the recording sheet are thermally fixed with a fixing unit 16. Then, the recording sheet is discharged by carrying rollers 18 to a catch tray 19 provided to the upper case 1.

Meanwhile, the upper case 1 includes four LED units 20K, 20Y, 20M, and 20C provided in positions that correspond to circumferential surfaces of the photoconductive bodies 11K, 11Y, 11M, and 11C of the drum units 10K, 10Y, 10M, and 10C, respectively. Each LED head (not shown) provided at a lower portion of each of the LED units 20K, 20Y, 20M, and 20C is configured with an LED array (not shown) of LEDs aligned linearly along a main scanning direction and a Selfoc Lens Array (SLA) being integrated. Further, the LED head has an exposure surface 20*a* as a surface directed in an illuminating direction of the LED head.

The LED units 20K, 20Y, 20M, and 20C are located close to circumferential surfaces of the photoconductive bodies 11K, 11Y, 11M, and 11C so as to expose the circumferential surfaces of the photoconductive bodies 11K, 11Y, 11M, and 11C, respectively. Each of the photoconductive bodies 11K, 11Y, 11M, and 11C is rotated in an arrow B direction and exposed linearly along a right-to-left direction (main scanning direction) thereof. Additionally, the upper case 1 includes cleaning units 30K, 30Y, 30M, and 30C that correspond to the LED units 20Y, 20M, 20C, and 20K, respectively.

It is noted that the drum units 10, photoconductive bodies 11, transfer rollers 12, LED units 20, and cleaning units 30 in general and, unless specified otherwise, are configured in the same manner, respectively. If it is required to distinguish each element of the same sort of component from the other elements, each element will be distinguished with a reference character (K), (Y), (M), or (C) representing a corresponding color attached thereto.

Figure 2:
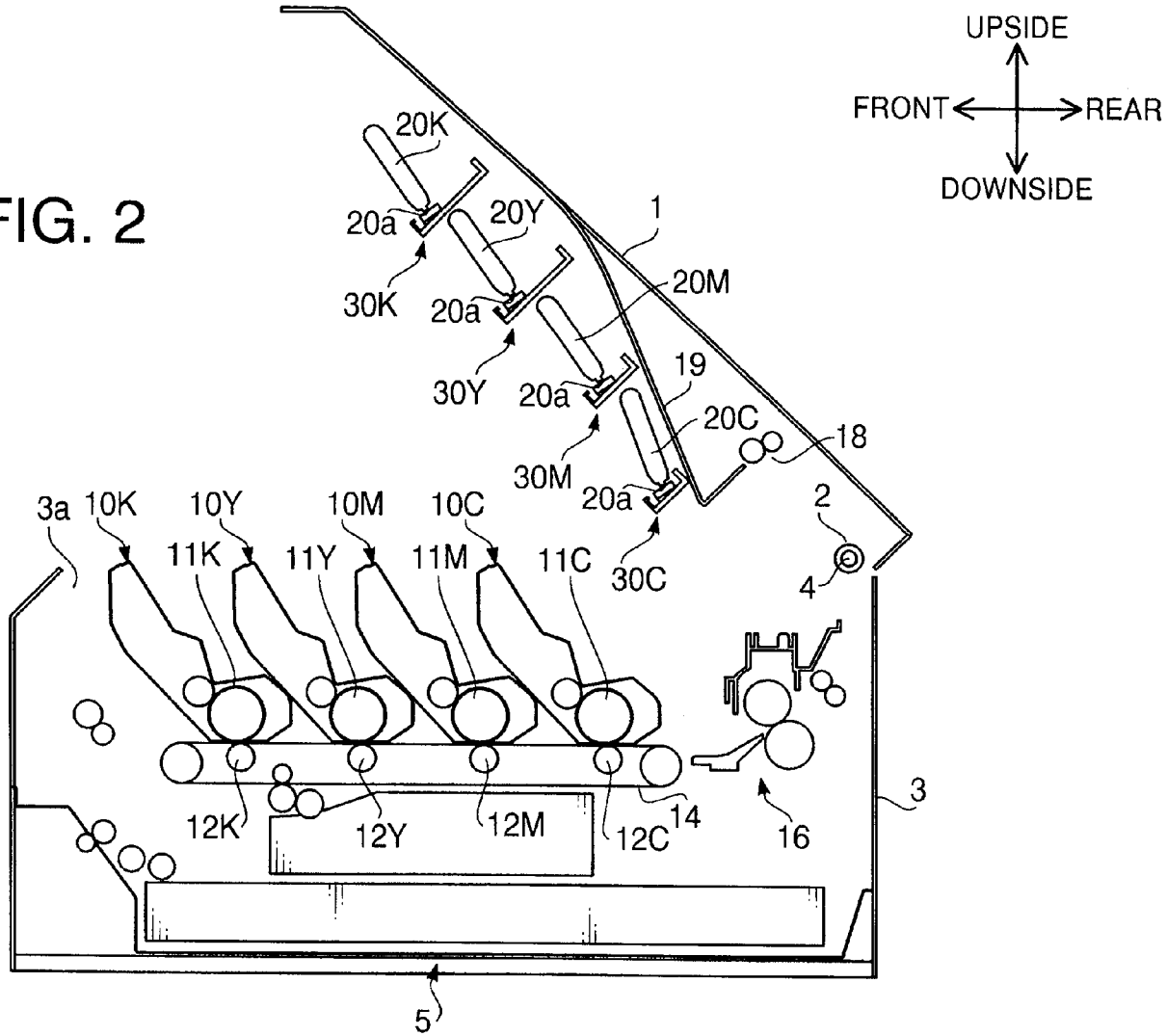
FIG. 2 is a cross-sectional view schematically showing the entire configuration of the LED printer when the upper case is closed in the first embodiment according to one or more aspects of the present invention.

FIG. 2 schematically shows the LED printer 5 when the upper case 1 is opened with respect to the mechanical unit 3. When the upper case 1 is opened, each LED unit 20 is turned in conjunction with the upper case 1 such that the exposure surface 20*a* of a corresponding LED head provided at a distal end of the LED unit 20 is set into a cleanable state to face a corresponding cleaning unit 20.

Figure 3:
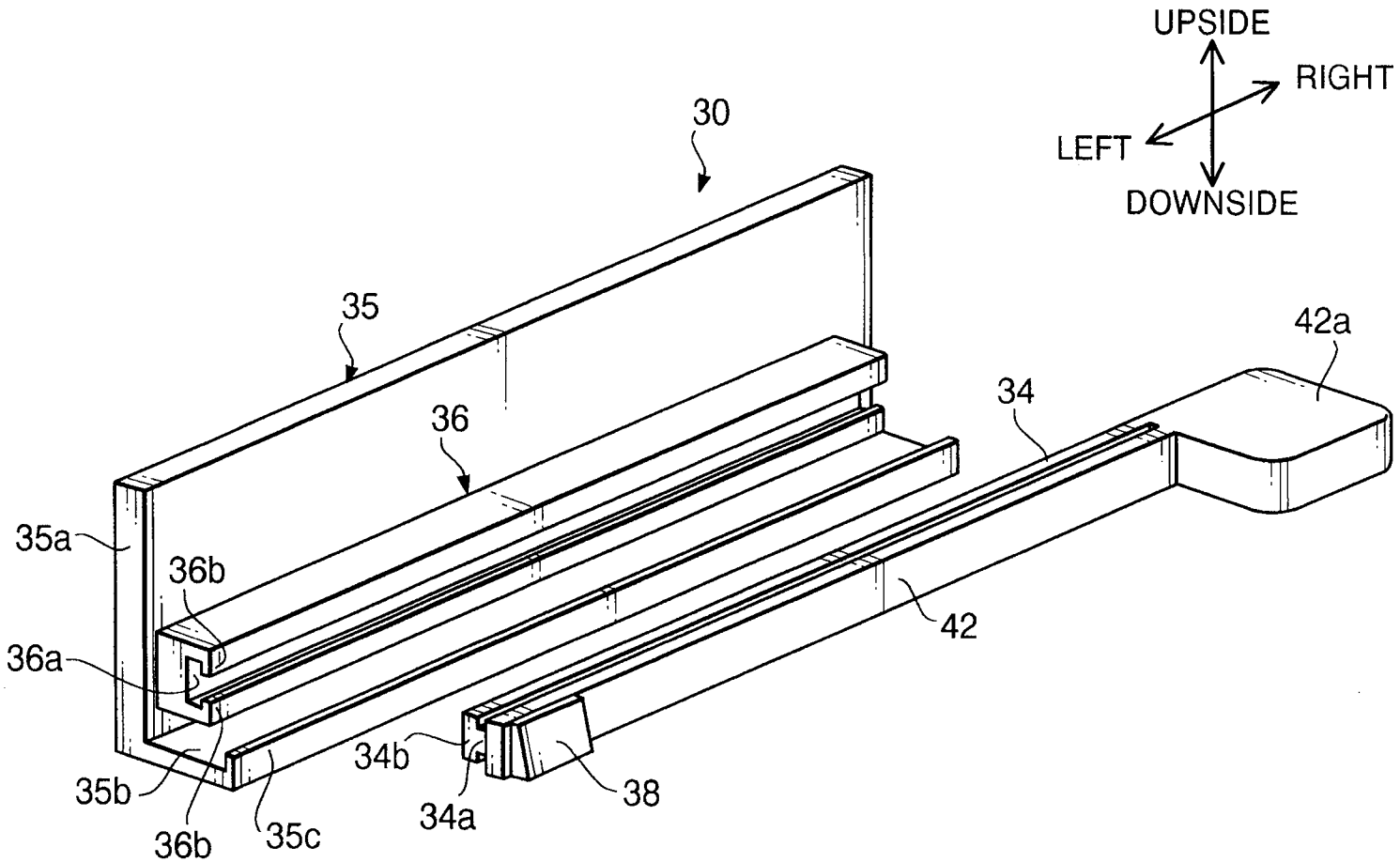
FIG. 3 is a perspective exploded view of a cleaning unit in the first embodiment according to one or more aspects of the present invention.

FIG. 3 is a perspective exploded view schematically showing the cleaning unit 30. The cleaning unit 30 is configured with a sponge member 38 for cleaning the exposure surface

20*a* of the LED unit 20, a supporting member 42 for supporting the sponge member 38, a guide member 36 for movably guiding the supporting member 42, and a removed object catching member 35 for catching an object as scraped off and removed.

The removed object catching member 35 is provided to catch a removed object (e.g., toner) scraped off from the exposure surface 20*a* of the LED unit 20 and configured to prevent the removed object from dropping down onto the drum unit 10 or the carrying belt 14. Specifically, the removed object catching member 35 extends in the main scanning direction (right-to-left direction) and includes a plate portion 35*a* substantially perpendicular to the upper case 1, and a catching portion 35*b* configured to extend substantially perpendicularly from the plate portion 35*a* and catch the removed object scraped off from the exposure surface 20*a*. Further, the removed object catching member 35 includes a stemming portion 35*c* configured to extend perpendicularly from the catching portion 35*b* and prevent the removed object from dropping down.

The plate portion 35*a* is supported with an upper portion thereof being attached to the upper case 1. It is noted that the plate portions 35*a* of the cleaning units 30M and 30C are shorter than the plate portions 35*a* of the cleaning units 30K and 30Y (see FIGS. 1 and 2). This is because a catch tray 19 is provided above the cleaning units 30M and 30C, and the cleaning units 30M and 30C are attached along a shape of the catch tray 19. It is noted that the plate portions 35*a* of the first embodiment are configured to have respective lengths according to a relationship 30C<30M<30Y=30K. However, the relationship between the lengths of the plate portions 35*a* is not limited to the above relationship, and may be determined to conform to the shape of the catch tray 19. Thus, for example, the plate portions 35*a* of the cleaning members 30K, 30Y, 30M, and 30C may be configured with the same length.

In addition, the plate portion 35*a* of the removed object catching member 35 includes the guide member 36 for guiding the supporting member 42. The guide member 36 is provided with a rectangular groove 36*a* and holding portions 36*b* that faces each other to cover the groove 36*a*.

The supporting member 42 is configured to be elongated in the main scanning direction. The sponge member 38 is attached to a left end of the supporting member 42, while a handle 42*a* is provided at a right end of the supporting member 42. Further, the supporting member 42 includes a slide member 34 that allows the supporting member 42 to slide.

The slide member 34 is provided opposite the sponge member 38 via the supporting member 42. The slide member 34 is configured with an arm portion 34*a* perpendicular to the supporting member 42 and a rectangular locking member 34*b* perpendicular to the arm portion 34*a*.

Figure 4:
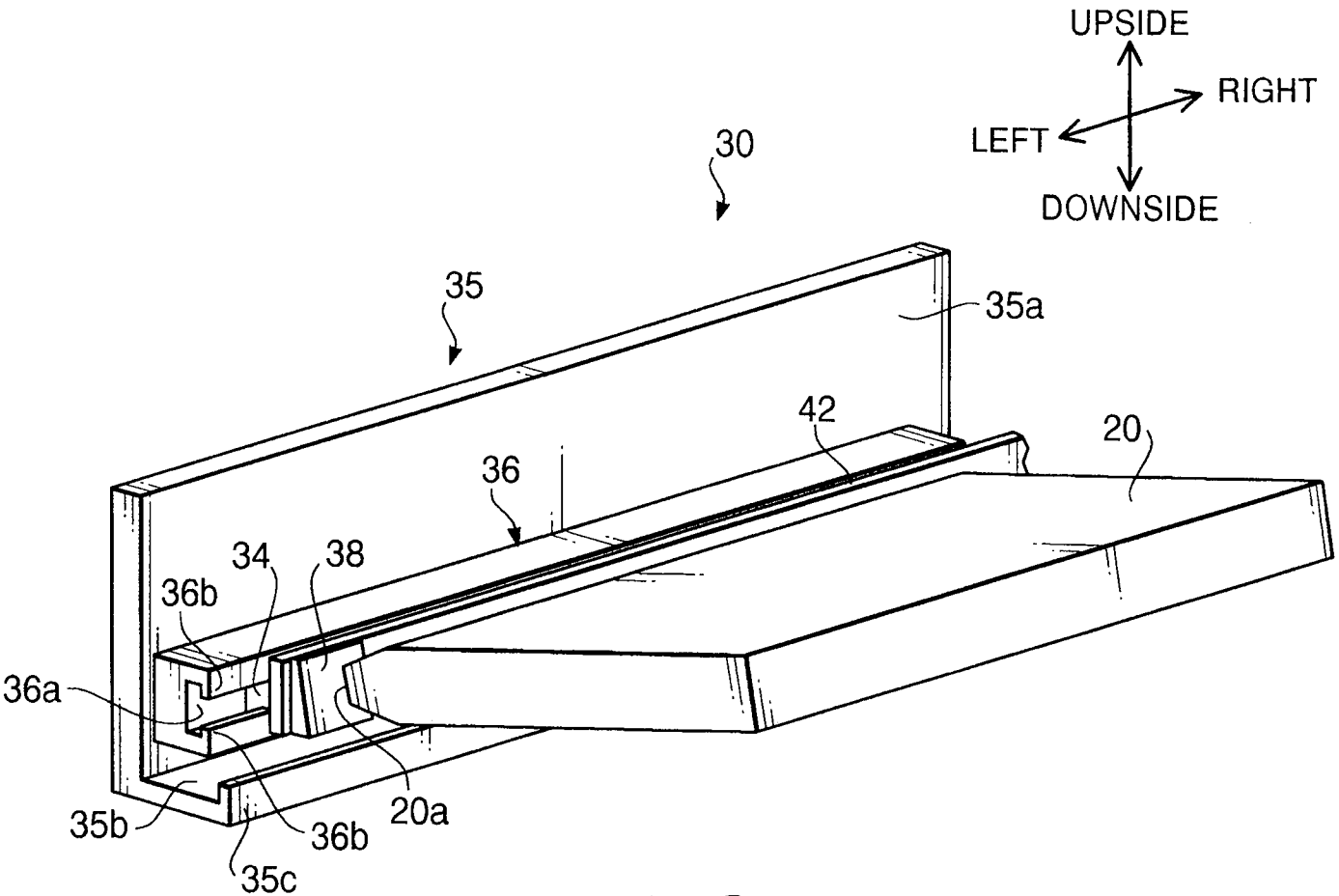
FIG. 4 is a perspective view schematically showing the cleaning unit and an LED unit in the first embodiment according to one or more aspects of the present invention.
Figure 5:
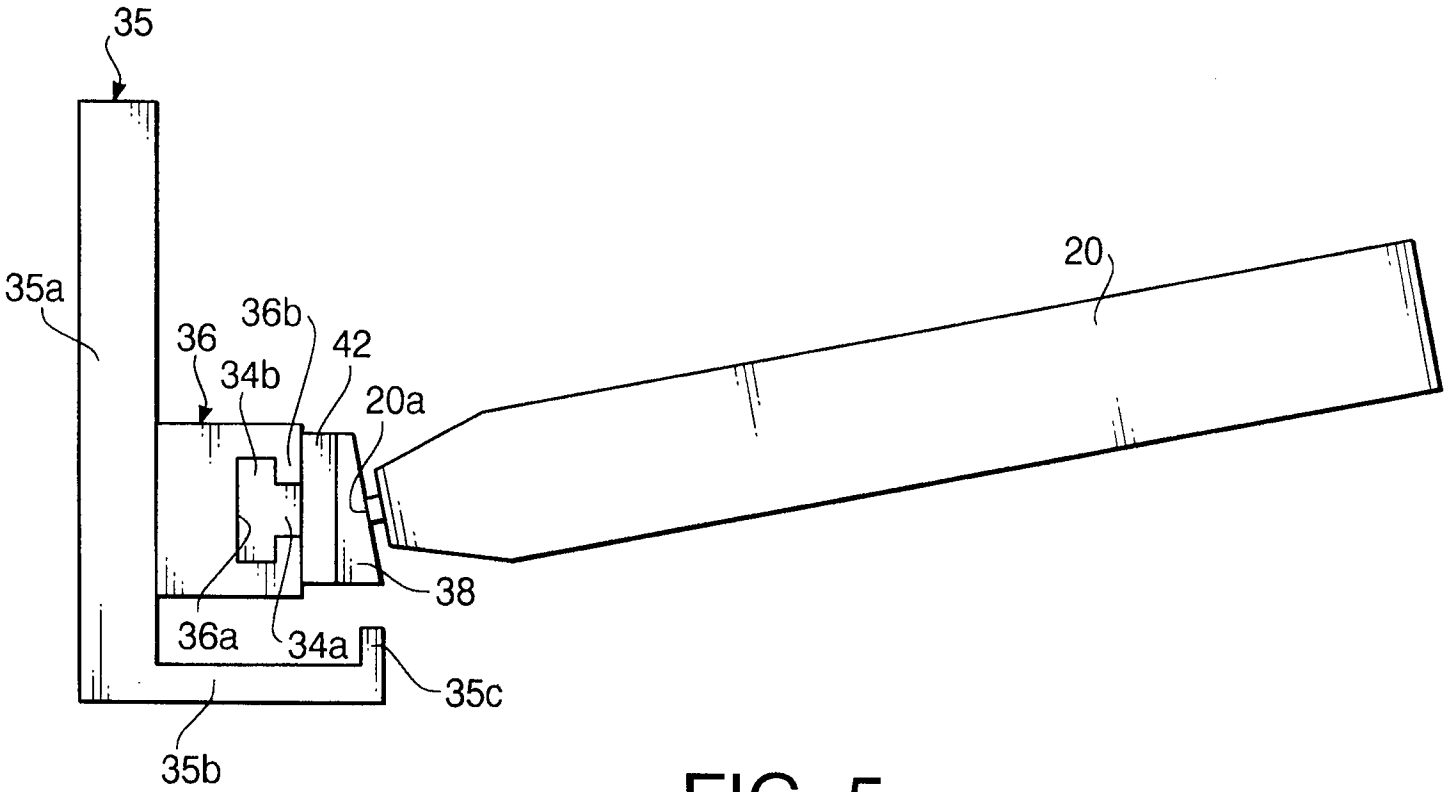
FIG. 5 is a side view schematically showing the cleaning unit and the LED unit in the first embodiment according to one or more aspects of the present invention.

FIGS. 4 and 5 are a perspective view and a side view schematically showing a state where the slide member 34 of the supporting member 42 is fitted along the guide member 36, respectively. The slide member 34 is slidably fitted along the groove 36*a* of the guide member 36. Specifically, the locking portion 34*b* of the slide member 34 is fitted along the groove 36*a*, and the locking portion 34*b* is held by the holding portions 36*b* of the guide member 36 and thus prevented from being dropped off the guide member 36.

In addition, the arm portion 34*a* is fitted into a space between the mutually-facing holding portions 36*b*, and the slide member 34 is configured to be movable along the guide member 36 by sliding the handle 42*a* in the right-to-left direction.

Figure 6:
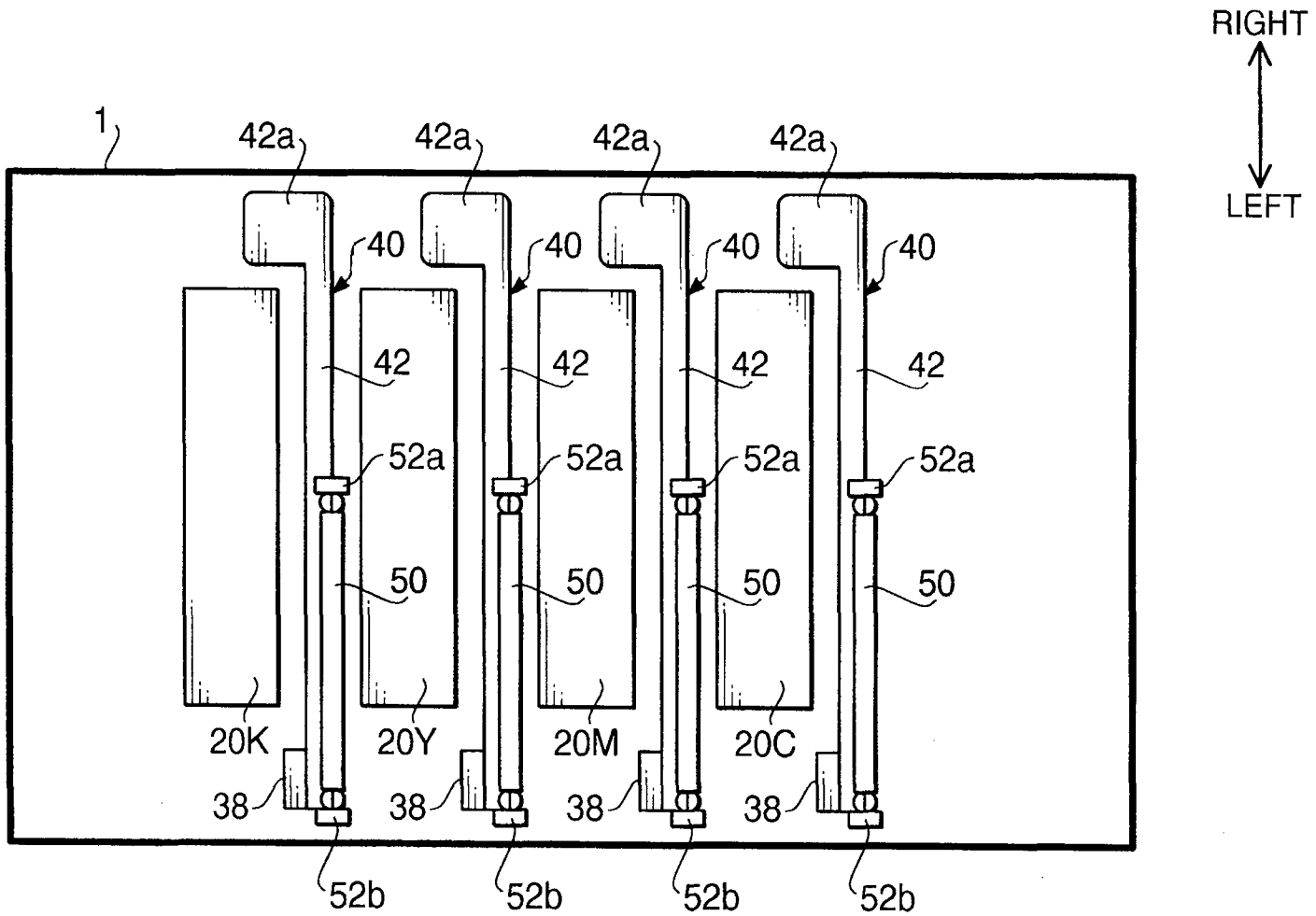
FIG. 6 is a bottom view schematically showing the upper case when the upper case is opened in the first embodiment according to one or more aspects of the present invention.

FIG. 6 is a bottom view schematically showing the state where the upper case 1 is opened (in the same manner as shown in FIG. 2). It is noted that the LED units 20, the supporting members 42, the sponge members 38, and spring members 50 here are only shown for the sake of descriptive convenience.

Each supporting member 42 is provided with a spring member 50 and biased by the spring member 50 toward a left side. Specifically, the spring member 50 is held while being hooked by a first spring hooking member 52*a* provided to the supporting member 42 and a second spring hooking member 52*b* provided to the upper case 1. Incidentally, in the state shown in FIG. 6, the supporting member 42 is in a stationary state biased by the spring member 50 with a left end thereof contacting the second spring hooking member 52*b*.

In FIGS. 4 and 5, the supporting member 42 is slightly shifted toward a right side by operating the handle 42*a*, and the sponge member 38 establishes contact with the exposure surface 20*a*. However, as far as the handle 42*a* is not operated, the supporting member 42 is located in a position shown in FIG. 6.

A state shown in FIG. 6 (where the upper case 1 is opened) represents a state where the sponge member 38 is located on a left side of the exposure surface 20*a* of the LED unit 20 in the main scanning direction, namely, the sponge member 38 does not contact the exposure surface 20*a* of the LED unit 20 in the left-to-right direction. When the handle 42*a* is moved toward the right side from the above state, the exposure surface 20*a* can be cleaned. Thus, since a user can clean the exposure surface 20*a* when the cleaning is needed, it is possible to restrain wear of the sponge member 38.

Further, since the supporting member 42 is biased toward the left side by the spring member 50, the supporting member 42 is moved back to an original position when the user takes off the handle 42*a* after cleaning the exposure surface 20*a*. Thereby, the supporting member 42 is certainly put into the original position.

In addition, the supporting member 42 is configured to come away from the guide member 36 by unhooking the spring member 50 from the first and second spring hooking members 52*a* and 52*b*. Thus, since the cleaning units 30 are provided to the upper case 1, and the supporting member 42 is configured to be slidable, even though the sponge member 38 is worn and deteriorated, the sponge member 38 can easily be replaced.

Further, a front face of the sponge member 38 is formed to be oblique from an upside to a downside for a following reason. When the upper case 1 is opened, the LED unit 20 gets still while being slightly oblique with respect to the catch tray 19. Therefore, the exposure surface 20*a* establishes contact not parallel but obliquely with the sponge member 38. Hence, the front face of the sponge member 38 is obliquely formed, and thus can contact the exposure surface 20*a* with no gap therebetween.

It is noted that a tilt angle of the LED unit 20C to the upper case 1 is greater than those of the LED units 20K, 20Y, and 20M. This is because the catch tray 19 is provided above the LED unit 20C, and the LED unit C is attached along the shape of the catch tray 19. In the first embodiment, the LED units 20 are attached to the upper case 1 with the tilt angles conforming to a relationship of 20C>20K=20Y=20M.

Figure 7:
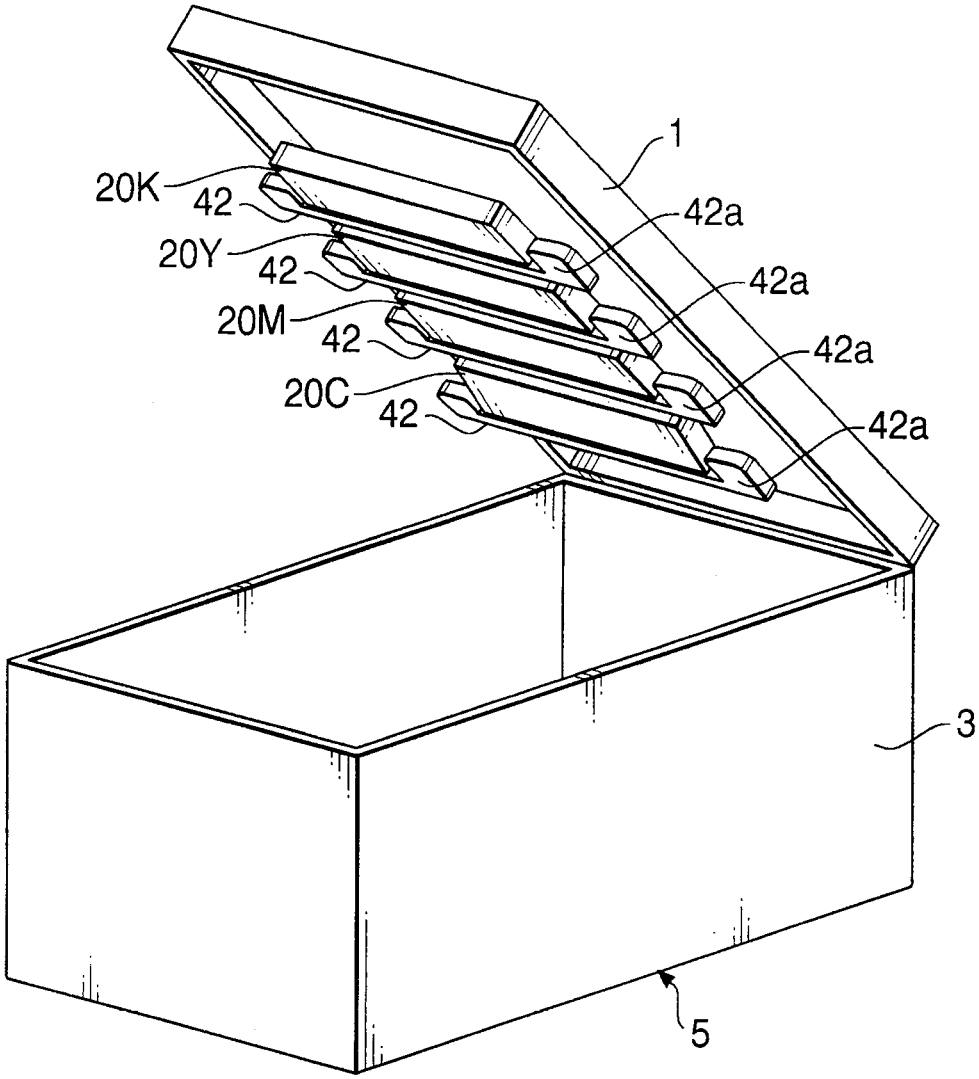
FIG. 7 is a perspective view schematically showing the LED printer when the upper case is opened in the first embodiment according to one or more aspects of the present invention.
Figure 8:
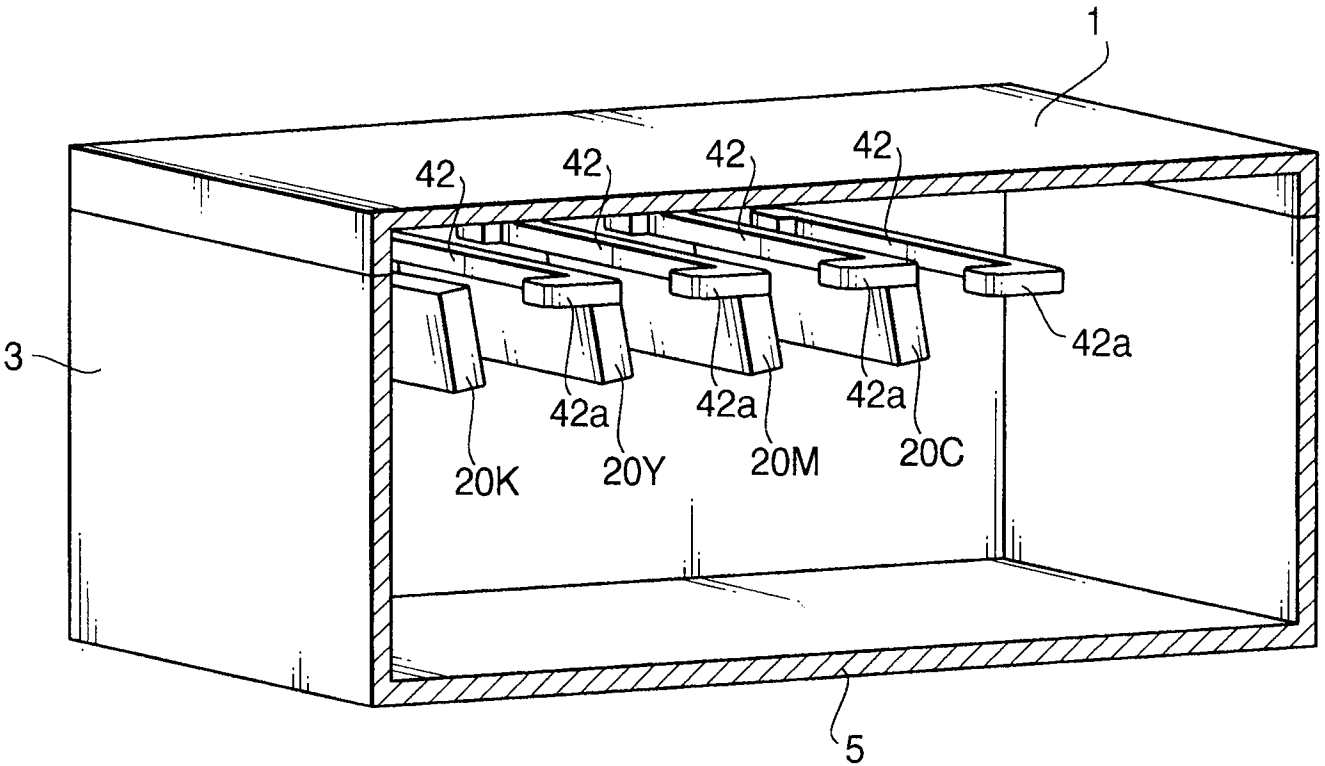
FIG. 8 is a perspective view schematically showing the LED printer when the upper case is closed in the first embodiment according to one or more aspects of the present invention.

FIG. 7 is a perspective view schematically showing the LED printer 5 when the upper case 1 thereof in the first embodiment is opened. FIG. 8 is a perspective view schematically showing the LED printer 5 when the upper case 1 thereof is closed. It is noted that, in FIGS. 7 and 8, the LED units 20, the supporting member 42, the handles 42*a*, and the sponge members 38 are only shown for the sake of descriptive convenience.

As shown in FIGS. 7 and 8, each supporting member 42 and each handle 42*a* are smaller than a width of the upper case 1 in the right-to-left direction. Further, each removed object catching member 35 is smaller than the upper case 1 as well (not shown in FIG. 7 or 8), and thus the cleaning units 30 are housed within the LED printer 5 when the upper case 1 is closed.

Additionally, as shown in FIG. 8, each handle 42*a* is provided lower than the upper case 1 in a vertical direction (upside-to-downside direction). Specifically, the handle 42*a* is housed within the mechanical unit 3 when the upper case 1 is closed. Meanwhile, the handle 42*a* can be operated to be movable without contacting the upper case 1 when the upper case 1 is opened. Thus, since the handle 42*a* can be moved when the upper case 1 is opened, it is possible to prevent an undesired accident that the user carelessly moves the sponge member 38. Further, since the handle 42*a* is housed, the handle 42*a* does not disturb a user's operation.

Figure 9:
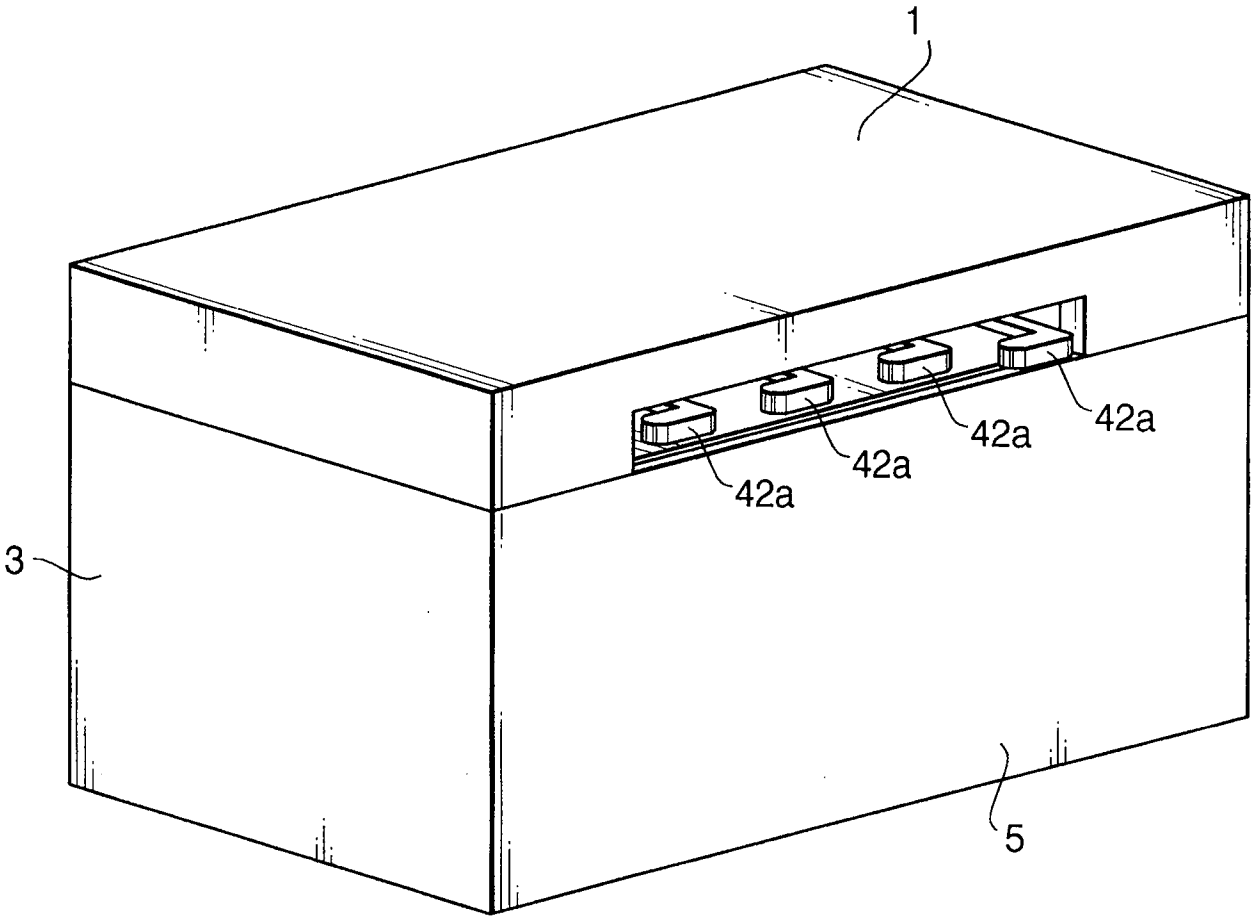
FIG. 9 is a perspective view schematically showing an LED printer in a second embodiment according to one or more aspects of the present invention.
Figure 10:
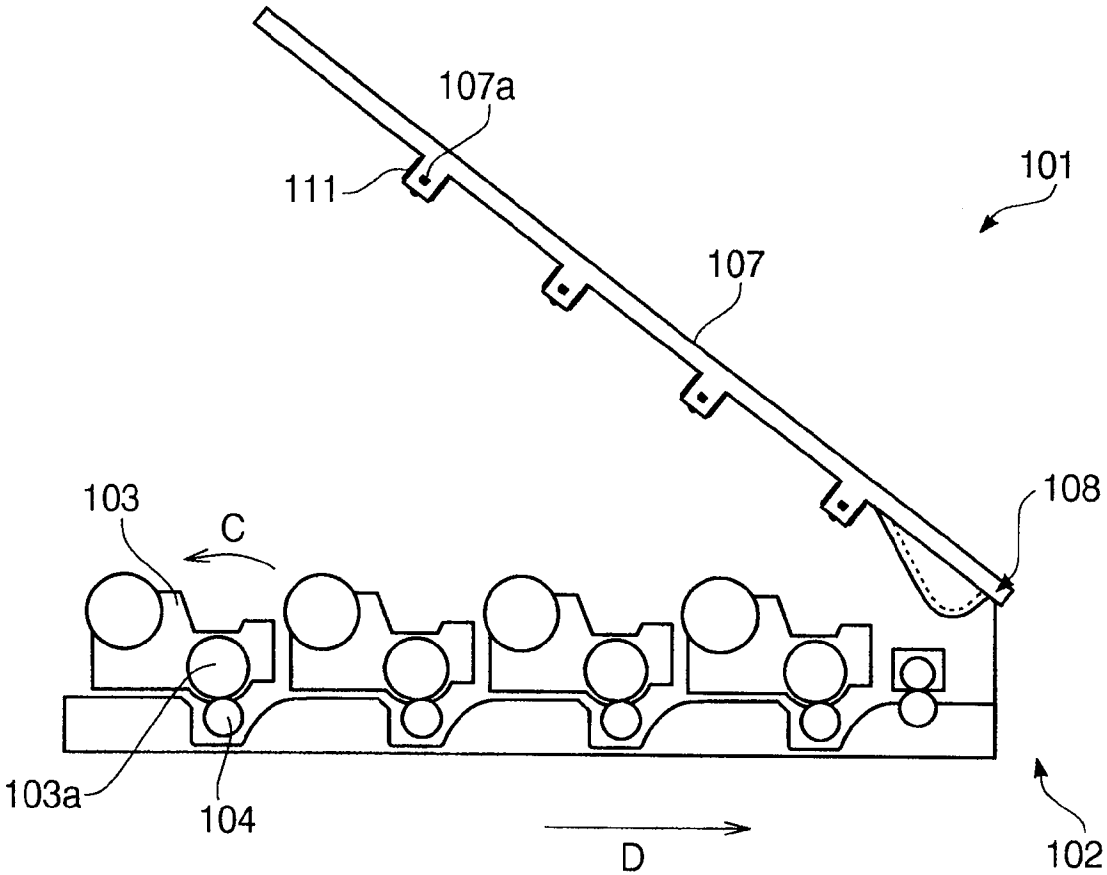
FIG.10 PRIOR ART
FIG. 10 is a cross-sectional side view schematically showing a known LED printer.

FIG. 9 is a perspective view schematically showing an LED printer 5 in a second embodiment according to aspects of the present invention. The LED printer 5 shown in FIG. 9 is in a state where an upper case 1 is closed, and handles 42*a* protrude from the upper case 1.

In the second embodiment, each handle 42*a* is exposed outside the LED printer 5. However, even though a handle 42*a* is moved, an exposure surface 20*a* of a corresponding LED unit 20 does not contact a corresponding sponge member 38 (see FIG. 1). Therefore, the sponge member 38 is not worn when the upper case 1 is closed. Thus, when an enough space to accommodate the handles 42*a* is not secured, the LED printer 5 configured as above may be possible.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a first device body having an opening;

a second device body attached to the first device body in an openable and closable manner, the second device body being configured to cover the opening of the first device body in a closed state thereof;

a photoconductive body provided in the first device body;

an exposure unit provided to the second device body, the exposure unit having an exposure surface configured to expose a surface of the photoconductive body linearly in a predetermined scanning direction and form a latent image on the surface of the photoconductive body, the exposure unit being configured to be movable between an exposure position where the exposure surface is directed to the surface of the photoconductive body when the second device body is closed and an evacuation position where the exposure unit is evacuated from the exposure position when the second body is fully open; and a cleaning unit configured to clean the exposure surface of the exposure unit, the cleaning unit including:

a cleaning member configured to clean the exposure surface of the exposure unit;

a supporting member configured to support the cleaning member; and a guide member configured to movably guide the supporting member, when the second device body is fully open, between a position where the cleaning member contacts the exposure surface of the exposure unit and a position where the cleaning member is separate from the exposure surface, wherein the cleaning unit is maintained in a fixed position relative to the second device body while the second device body is being opened, and wherein the exposure unit is configured to move relative to the second device body while the second device body is being opened and placed in the evacuation position where the exposure surface faces the cleaning unit so as to be cleaned by the cleaning unit when the second body is fully open.

2. The image forming device according to claim 1, wherein the cleaning member is supported at a first end of the supporting member in the predetermined scanning direction, wherein the cleaning unit includes:

a handle provided at a second end of the supporting member opposite to the first end in the predetermined scanning direction, and a biasing member configured to bias the supporting member toward the first end from the second end along the predetermined scanning direction, and wherein the supporting member is moved against the biasing member when the handle is moved.

3. The image forming device according to claim 2, wherein the exposure surface of the exposure unit is located on a side of the second end of the cleaning member in the predetermined scanning direction when the second device body is opened.

4. The image forming device according to claim 2, wherein the handle is housed in the first device body when the second device body is closed, and wherein the handle is operable when the second device body is opened.

5. The image forming device according to claim 1, wherein the cleaning unit includes a removed object catching member provided at a lower portion thereof to catch an object removed from the exposure surface of the exposure unit by the cleaning unit.

6. An image forming device, comprising:

a first device body having an opening;

a second device body attached to the first device body in an openable and closable manner, the second device body being configured to cover the opening of the first device body in a closed state thereof;

a photoconductive body provided in the first device body;

an exposure unit provided to the second device body, the exposure unit having an exposure surface configured to expose a surface of the photoconductive body along a predetermined scanning direction and form a latent image on the surface of the photoconductive body, the exposure unit being configured to be movable between a first position where the exposure surface is directed to the surface of the photoconductive body and a second position where the exposure unit is evacuated from the first position when the second device body is fully open;

a cleaning unit configured to clean the exposure surface of the exposure unit, wherein the cleaning unit maintains a fixed position relative to the second device body while the second device body is being opened; and a guide member configured to movably guide a supporting member of the cleaning unit, when the second device body is fully open, between a position where a cleaning member supported by the supporting member contacts the exposure surface of the exposure unit and a position where the cleaning member is separate from the exposure surface, and wherein the exposure unit is configured to move relative to the second device body while the second device body is being opened and placed in the second position where the exposure surface faces the cleaning unit so as to be cleaned by the cleaning unit when the second body is fully open.

7. The image forming device according to claim 6, wherein the cleaning member is supported at a first end of the supporting member in the predetermined scanning direction, wherein the cleaning unit includes:

a handle provided at a second end of the supporting member opposite to the first end in the predetermined scanning direction, and a biasing member configured to bias the supporting member toward the first end from the second end along the predetermined scanning direction, and wherein the supporting member is moved against the biasing member when the handle is moved.

8. The image forming device according to claim 7, wherein the exposure surface of the exposure unit is located on a side of the second end of the cleaning member in the predetermined scanning direction when the exposure unit is located in the second position.

9. The image forming device according to claim 7, wherein the handle is housed in the first device body when the second device body is closed, and wherein the handle is operable when the second device body is opened.

10. The image forming device according to claim 6, wherein the cleaning unit includes a removed object catching member provided at a lower portion thereof to catch an object removed from the exposure surface of the exposure unit by the cleaning unit.

* * * * *